US009248328B2

(12) United States Patent
Qiang et al.

(10) Patent No.: US 9,248,328 B2
(45) Date of Patent: Feb. 2, 2016

(54) EXPLOSION-VENTING METHOD FOR AEROSOL FIRE SUPPRESSION APPARATUS

(75) Inventors: Jian Qiang, Shaanxi (CN); Zhengjun Lei, Shaanxi (CN)

(73) Assignee: XI'AN J&R FIRE FIGHTING EQUIPMENT CO., LTD. (CN)

( * ) Notice: Subject to any disclaimer, the term of this patent is extended or adjusted under 35 U.S.C. 154(b) by 16 days.

(21) Appl. No.: 14/239,376

(22) PCT Filed: Aug. 15, 2012

(86) PCT No.: PCT/CN2012/080189

§ 371 (c)(1),
(2), (4) Date: Feb. 18, 2014

(87) PCT Pub. No.: WO2013/023605

PCT Pub. Date: Feb. 21, 2013

(65) Prior Publication Data

US 2014/0202715 A1 Jul. 24, 2014

(30) Foreign Application Priority Data

Aug. 16, 2011 (CN) ..... 2011 1 0235104

(51) Int. Cl.
*A62C 2/00* (2006.01)
*A62C 35/68* (2006.01)
(Continued)

(52) U.S. Cl.
CPC ..... *A62C 35/68* (2013.01); *A62C 13/02* (2013.01); *A62C 19/00* (2013.01)

(58) Field of Classification Search
CPC ..... A62C 13/64; A62C 13/22; A62C 13/003; A62C 5/006
USPC ..... 169/30, 75, 77, 78
See application file for complete search history.

(56) References Cited

U.S. PATENT DOCUMENTS 3,788,514 A * 1/1974 Giacoma et al. ..... 220/89.1
6,305,131 B1 * 10/2001 Romig ..... 52/79.1
(Continued)

FOREIGN PATENT DOCUMENTS

CA 2755513 A1 12/2010
CN 201239453 Y 5/2009
(Continued)

OTHER PUBLICATIONS

International Search Report for corresponding application PCT/CN2012/080189 filed Aug. 15, 2012; Mail date Nov. 29, 2012.
(Continued)

*Primary Examiner* — Davis Hwu
(74) *Attorney, Agent, or Firm* — Cantor Colburn LLP

(57) ABSTRACT

An explosion-venting method for an aerosol fire suppression apparatus, comprising the following steps: 1) when the aerosol fire suppression apparatus explodes, an explosion-venting device matching the aerosol fire suppression apparatus generating a limited displacement along a direction that a hot air stream of the aerosol fire suppression apparatus is jetting towards; 2) when an extremity of the explosion-venting device reaches an edge of the aerosol fire suppression apparatus, being limited, the explosion-venting apparatus stops the displacement along the direction that the hot air stream of the aerosol fire suppression apparatus is jetting towards, thus achieving for the aerosol fire suppression apparatus the effects of explosion-venting and reduced recoil force.

9 Claims, 3 Drawing Sheets

(51) Int. Cl.
*A62C 19/00* (2006.01)
*A62C 13/02* (2006.01)

(56) References Cited

U.S. PATENT DOCUMENTS

| | | | | |
|---|---|---|---|---|
| 6,394,188 | B1 * | 5/2002 | Zwergel | 169/85 |
| 2006/0231272 | A1 | 10/2006 | Thompson | |
| 2009/0301738 | A1 | 12/2009 | Gross | |
| 2010/0116515 | A1 * | 5/2010 | Felten et al. | 169/71 |
| 2011/0120735 | A1 | 5/2011 | Huang | |
| 2014/0231108 | A1 * | 8/2014 | Qiang et al. | 169/75 |

FOREIGN PATENT DOCUMENTS

| | | | |
|---|---|---|---|
| CN | 201815031 | U | 5/2011 |
| CN | 202236979 | U | 5/2012 |
| JP | 2011062340 | A | 3/2011 |

OTHER PUBLICATIONS

Written Opinion for corresponding application PCT/CN2012/080189 filed Aug. 15, 2012; Mail date Nov. 29, 2012.

* cited by examiner

EXPLOSION-VENTING METHOD FOR AEROSOL FIRE SUPPRESSION APPARATUS

TECHNICAL FIELD OF THE INVENTION

The present invention relates to a gas fire suppression technology in the field of fire control safety, and more particularly to a method capable of preventing explosion and venting pressure.

BACKGROUND OF THE INVENTION

At present, a pyrotechnic compound that burns fast is applied as the main charge compound of an existing fire extinguisher. A grain is coated with a heat insulation material and then installed at the bottom of an inner cylinder of a product. The inner cylinder is assembled after a coolant and an inner cylinder cover assembly are added to the front half of the inner cylinder. When the product acts normally, a great deal of aerosol smoke is generated by the grain through sequential and stratified combustion. These high temperature aerosols are cooled by a coolant layer and then spouted out through a nozzle to act on a fire source directly to suppress a fire. However, a coating defect, a pyrotechnic grain crack or a serious blockage of a gas channel may lead to a sudden rise of the pressure in a cylinder body to deflagrate the grain. A gas with an ultra-high pressure which is increased quickly is vented forwards rapidly to thrust the nozzle apart and strike the nozzle outwards, thus causing an extremely large recoil force. The powerful recoil force drives the cylinder body to move backwards rapidly, which is very easy to cause a serious injury to an operator. At the same time, after explosion ventilation, a hot air stream will be accumulated in the cylinder body, and the inner cylinder cover assembly etc. of the aerosol fire suppression apparatus will also break away from the cylinder body at an extremely high speed and fly outwards for a relatively long distance, which may cause other accidents or even more serious accidents including an explosion of the cylinder body of the inner cylinder, and the like when an accumulated pressure is too high.

However, most aerosol fire suppression apparatuses are in lack of corresponding measures or means for solving the problems above at present. Therefore, structures or methods of existing aerosol fire suppression apparatuses need to be improved to avoid personnel injuries and other injuries caused by deflagration.

SUMMARY OF THE INVENTION

The purpose of the present invention is to provide a method capable of preventing explosion and venting pressure effectively, thus solving the defect in an existing aerosol fire suppression apparatus that a powerful recoil force generated after deflagration will cause injuries to personnel and an cylinder will explode or an inner cylinder assembly will fly outwards at a great speed to cause other injuries.

A technical means applied by the present invention includes:

an explosion-venting method for an aerosol fire suppression apparatus is special in that: the method comprise the following steps:

Step 1: when the aerosol fire suppression apparatus (1) deflagrates, an explosion-venting device (2) matching the aerosol fire suppression apparatus (1) generates a limited displacement along a direction that a hot air stream of the aerosol fire suppression apparatus (1) is jetting towards;

Step 2: when an extremity of the explosion-venting device (2) reaches an edge of the aerosol fire suppression apparatus (1), being limited, the explosion-venting apparatus (2) stops the displacement along the direction that the hot air stream of the aerosol fire suppression apparatus (1) is jetting towards, thus achieving for the aerosol fire suppression apparatus (1) the purpose of explosion-venting.

The explosion-venting device (2) of the present invention comprises a friction layer (7), a connecting rod (5), a guiding unit (6) and a limiting device (8), wherein the guiding unit (6) provides a sliding guide function for the connecting rod (5) when the connecting rod is moving; the connecting rod (5) is fixedly connected with the aerosol fire suppression apparatus (1) through the limiting device (8); when an extremity of the connecting rod (5) is to be separated from the aerosol fire suppression apparatus (1), the limiting device (8) limits the connecting rod.

The guiding unit of the present invention may be a guiding ring (12) fixedly connected with the connecting rod (5) or a guiding groove arranged on an outer wall of the aerosol fire suppression apparatus (1) and capable of making the connecting rod (5) slide along the guiding groove, or other structures as long as the connecting rod can be guided.

The limiting device (8) of the present invention is arranged on one end, which is arranged with a nozzle, of the aerosol fire suppression apparatus (1).

A displacement of the connecting rod (5) of the present invention is within 30 mm to 80 mm, preferably 50 mm to 60 mm, which may be further adjusted adaptively, however, according to the size of a cylinder body (3) of the aerosol fire suppression apparatus (1), and an agent dosage etc.

Further, the limiting device (8) of the present invention comprises a flanging (9) fixedly connected with a nozzle end of the aerosol fire suppression apparatus (1) and a clamping claw (10) for fixing the connecting rod (5). A buffering component (11) may be further arranged between the flanging (9) and the guiding ring (12). When colliding with the flanging (9), the extremity of the connecting rod (5) or the guiding ring (12) can buffer an impact force and consume kinetic energy.

The aerosol fire suppression apparatus of the present invention may be a portable fire suppression apparatus or a fixed fire suppression apparatus etc. The method of the present invention can be applied to explosion prevention and pressure ventilation effectively for fire suppression apparatuses that grain deflagration occur mainly.

The deflagration in the present invention means that a pyrotechnic grain which is cracked or broken or having an ineffective external coating is ignited to burn heavily within an extremely short period of time that is only about 1/10 of normal stratified combustion. After the deflagration of the grain, a great deal of high pressure and high temperature gases will be generated instantaneously.

Analyzed with physical principles, the total momentum of a system remains unchanged if an external force is not applied on the system or the sum of vectors of applied external forces is zero, which is called the law of conservation of momentum. When the initial state of an object is relatively static and the shape or the speed of each part of the object is changed by an internal force, the process can be described by the law of conservation of momentum and expressed by the following mathematical formula: $\Sigma M_i V_i$ before$=\Sigma M_i V_i$after$=\Delta MV=0$. As described above, when a relatively static object explodes, the momentum of the object is conservative before and after the explosion. In addition, whether before the explosion or after the explosion, the sum of (vectors) momentums of all parts of the object in these two states are zero. When a relatively static object explodes, there may be infinitely many fragments formed thereby and infinitely many directions towards which the fragments fly. However, according to vector decomposition and synthesis principles, the present invention may decompose directions of motions of the fragments after the explosion into three directions X, Y and Z. In these three directions, a method for expressing conservation of (vector) momentum after the explosion is $\Sigma M_x V_x = \Sigma M_y V_y = M_z V_z = \Delta MV = 0$. Taking a human as a reference, it is defined in the present invention that the anterio-posterior direction is the X direction, the right-left direction is the Y direction and the up-down direction is the Z direction. In a limited explosion process to be described hereinafter, opposite movements in the Y and Z directions mainly refer to opposite overflowing of gases, which will not cause injuries to an operator. Therefore, researches on the Y and Z directions are omitted in the present invention. Thus, the formula of conservation of momentum after the explosion is changed into $\Sigma M_x V_x = \Delta MV = 0$.

When a pyrotechnic compound explodes limitedly between the cylinder body (3) and a cylinder cover assembly (4), if measures are not taken, the cylinder body (3) and the cylinder cover assembly (4) will be respectively pushed away along the +X direction and the −X direction rapidly by a high pressure gas, and the cylinder body (3) moving rapidly towards the −X direction may seriously wound an operator, as a result of the absence explosion venting measures.

The principle of the explosion-venting method of the present invention is as follows: according to Newton's third law and the law of conservation of momentum above, the converted kinetic energy in the +X direction and the −X direction are consumed as much as possible within a limited distance. In this way, the cylinder cover assembly (4) will not gain a great speed to fly relatively far, thus preventing injuries or damages to personnel and objects touched by the cylinder cover assembly, nor will the cylinder body (3) injure the operator at the back. A method for consuming the kinetic energy and reducing the speed of opposite motions between the cylinder body (3) and the cylinder cover assembly (4) includes:

firstly, the present invention provides a certain connection strength between the cylinder body (3) and the cylinder cover assembly (4); the cylinder body (3) and the cylinder cover assembly (4) will be separated (blast away) as long as a limited explosion overcomes the connection strength, i.e. the bent and tightly-clamped clamping claw (10) for connecting the fixing rod (5); during the overcoming process, energy generated by the explosion will be partly consumed; however, the connection strength should not be too high, otherwise, a system formed by the cylinder body (3) and the cylinder cover assembly (4) will be exploded into pieces and great danger will be caused;

secondly, when the cylinder body (3) and the cylinder cover assembly (4) slide oppositely, a contact surface therebetween is added with a material having a relatively large friction coefficient, i.e. the friction layer (7); in this way, when an opposite displacement is generated between the two objects, a part of the kinetic energy generated by the explosion is further consumed because of acting (energy consumption) of an frictional force of the friction layer (7);

thirdly, after sliding for a limited distance, the cylinder body (3) and the cylinder cover assembly (4) will collide; according to the theorem of momentum, the momentum increment of an object is equal to the impulse of the sum of external forces applied on the object, i.e. $F\Delta t = \Delta mv$, or the sum of vectors of the impulses of all external forces. According to this theorem, the speed to be reduced by the present invention now is fixed, i.e. $\Delta V$ is fixed, and the mass m of an opposite motion is also fixed, then a collision duration $\Delta t$ between the cylinder body (3) and the cylinder cover assembly (4) has to be prolonged in order to reduce a collision force therebetween; the buffering component (11) is arranged on a collision plane between the cylinder body (3) and the cylinder cover assembly (4) to prolong the collision duration between the two objects to further reduce the collision acting force between the two objects; from the perspective of energy consumption, such a measure is to convert the kinetic energy of opposite running of the two objects into elastic potential energy of the buffering component (11) so as to consume part of the kinetic energy between the objects moving oppositely;

fourthly, when the buffering component (11) is pressed to the limit, the stored elastic potential energy will be partly released, which is equal to a compression spring which rebounds after being compressed to the limit; the released elastic potential energy will bounce the tightly squeezed cylinder body (3) and cylinder cover assembly (4) apart so as to reduce the speed of the opposite movements between the cylinder body (3) and the cylinder cover assembly (4); thus a part of kinetic energy of the movements will be also consumed;

fifthly, a blocking edge, i.e. the flanging (9) is arranged at the nozzle of the cylinder body (3) in the present invention, and the cylinder cover assembly (4) has to pull the flanging (9) flat to get rid of the cylinder body (3). During the pulling process, the two objects need to overcome deformation potential energy of the flanging (9) of the cylinder body (3) so as to consume the final kinetic energy between the two objects.

Using the five methods above within a limited displacement of an explosion-venting device, the explosion-venting method for an aerosol fire suppression apparatus of the present invention completely consumes or disperses powerful kinetic energy generated by an explosion, thus allowing smooth ventilation or dispersion of the powerful explosion kinetic energy. On one hand, an operator can be prevented from being injured by a powerful recoil force generated by deflagration. On the other hand, a hot air stream generated after the deflagration of a grain can be effectively consumed or dispersed in time to prevent an excessive pressure in a cylinder body from being accumulated to cause the danger of an explosion rupture on the cylinder body and a housing of the fire suppression apparatus. At the same time, it can be ensured that the cylinder cover assembly will not fly outwards at a great speed to cause accidents to injure personnel or damage materials.

in the figures: 1—aerosol fire suppression apparatus; 2—explosion-venting device; 3—cylinder body; 4—cylinder cover assembly; 5—connecting rod; 6—guiding unit; 7—friction layer; 8—limiting device; 9—flanging; 10—clamping claw; 11—buffering component; 12—guiding ring.

DETAILED DESCRIPTION OF THE INVENTION

An explosion-venting method for an aerosol fire suppression apparatus of the present invention is mainly implemented by the following steps:

Step 1: when the aerosol fire suppression apparatus 1 deflagrates, an explosion-venting device 2 matching the aerosol fire suppression apparatus 1 generates a limited displacement along a direction that a hot air stream of the aerosol fire suppression apparatus 1 is jetting towards;

Step 2: when the explosion-venting device 2 is to be separated from the aerosol fire suppression apparatus 1, the explosion-venting device 2 is limited to stop the displacement, thus preventing the explosion-venting device from being separated from the aerosol fire suppression apparatus 1 to achieve for the aerosol fire suppression apparatus 1 the effect of explosion-venting.

An existing portable fire suppression apparatus is taken as an example in the present embodiment. An inner cylinder is arranged in a housing. The inner cylinder mainly comprises a cylinder body 3 and a cylinder cover assembly 4 arranged on the front end of the cylinder body 3. A grain is arranged at the bottom of the cylinder body 3. A hot aerosol generated by combustion of the grain is discharged through a nozzle of the cylinder cover assembly 4 to suppress a fire. However, a hot air stream is discharged through the cylinder cover assembly 4 after the grain deflagrates accidentally.

Figure 1:
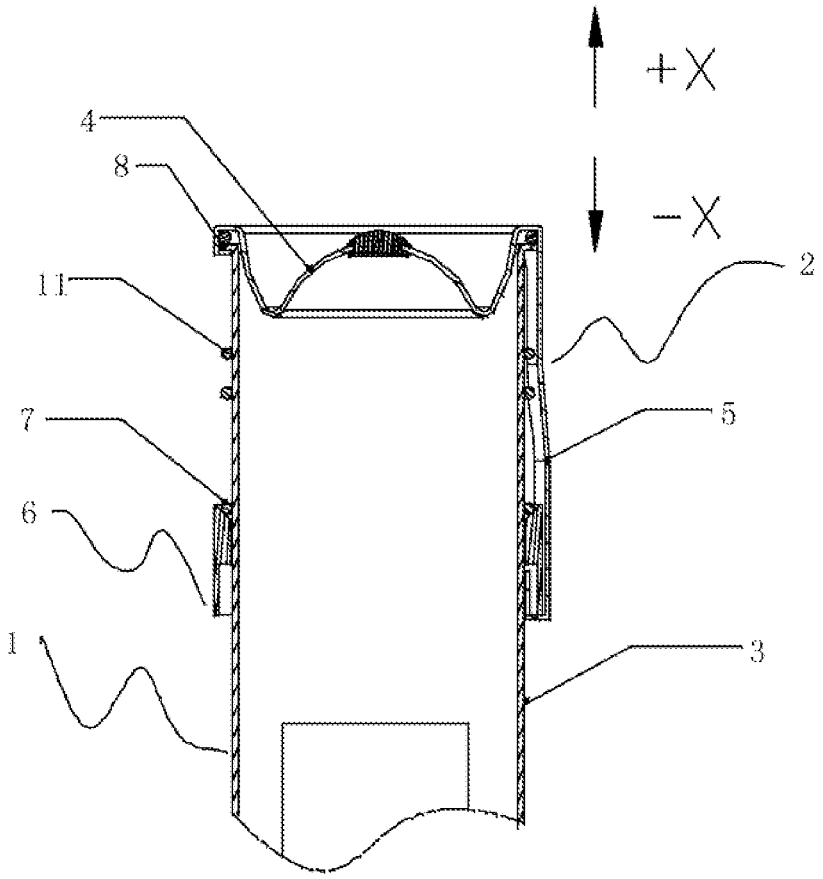
FIG. 1 is a sectional view of an explosion-venting device of an embodiment of the present invention.
Figure 2:
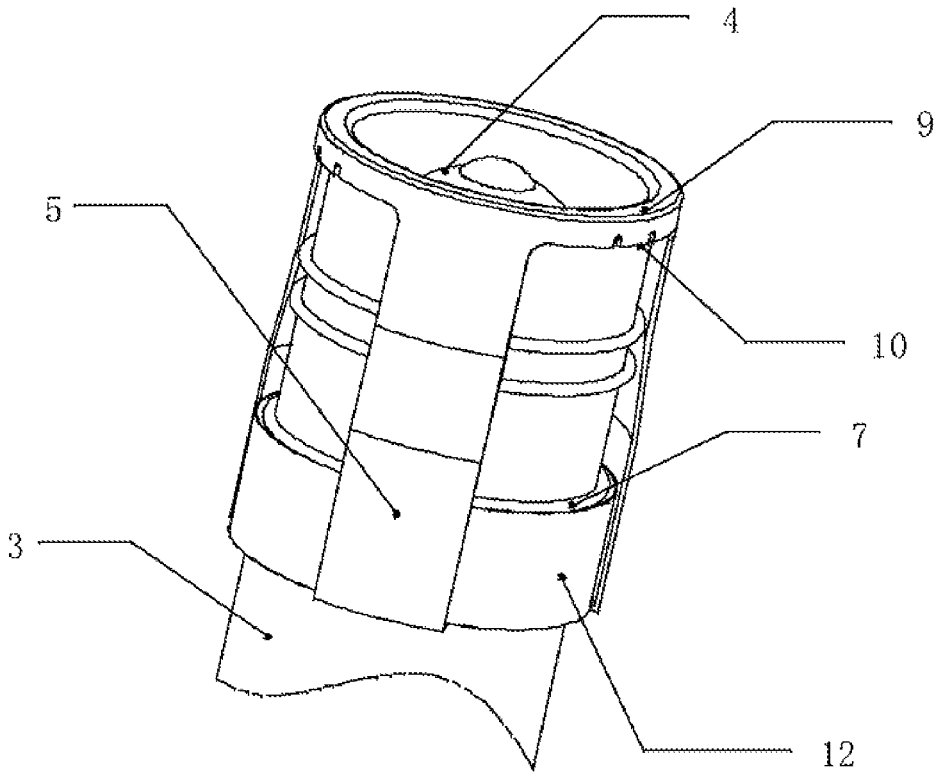
FIG. 2 is a diagram illustrating an initial state of an explosion-venting device of an embodiment of the present invention.

Referring to FIG. 1 and FIG. 2, an explosion-venting device 2 of the present invention comprises a friction layer 7, a connecting rod 5, a guiding unit 6 and a limiting device 8. The friction layer 7 of the explosion-venting device 2 of the present invention is arranged between the connecting rod 5 and a wall of a cylinder body of an inner cylinder of an aerosol fire suppression apparatus 1. When the connecting rod 5 is guided by the guiding unit 6 to displace along an outer wall of the cylinder body of the aerosol fire suppression apparatus 1 toward a direction that a hot air stream is jetting towards, the friction layer 7 generates a frictional resistance at the moment because an elastic effect of the friction layer acts on the connecting rod 5 and the outer wall of the cylinder body 3. The friction layer may be a plastic or rubber material, or other elastic materials that can provide a relatively large elastic coefficient. The friction layer 7 is an integral body or may be a plurality of separate bodies, depending on a specific application environment and a test effect. The guiding unit 6 of the present invention, which is able to guide the connecting rod 5 when the same is moving, may be a guiding ring 12 fixedly connected with the connecting rod 5, a guiding groove arranged on an outer wall of the cylinder body 3 and capable of making the connecting rod 5 slide axially along the guiding groove, or a slide rail or other structures, as long as the connecting rod can be guided when moving. Taking a guiding ring 12 for example, the guiding ring 12 may be further connected fixedly and integrally with the connecting rod 5 through methods including clamping, riveting or welding etc. The limiting device 8 of the present invention is arranged on one end, which is arranged with a nozzle, of the cylinder body 3 of the inner cylinder of the aerosol fire suppression apparatus 1 and mainly comprises a flanging 9 or a lug boss fixedly connected with the inner cylinder of the aerosol fire suppression apparatus 1 and a clamping claw 10 for fixing the connecting rod 5. A buffering component 11 is arranged between the flanging 9 or the lug boss and the guiding ring 12 or is arranged on the flanging 9 to buffer a collision force between an extremity of the connecting rod 5 and the front end of the cylinder body 3 of the aerosol fire suppression apparatus 1, and consume a part of motion kinetic energy with an elastic effect of itself. The flanging 9 of the present invention is mainly used for limiting the fire suppression apparatus when the same is displaced. On the other hand, when an impact force of the cylinder body 3 is too large, a part of kinetic energy can be consumed by overcoming a strength resistance of the flanging which has certain strength. Therefore, the flanging 9 of the present embodiment may be replaced by all structures that can mainly realize the first purpose or the two purposes above, thus forming another embodiment. The flanging 9 or the lug boss may be further integrated with the guiding groove of the guiding unit 6. The connecting rod 5 may be fixed on the cylinder body 3 of the aerosol fire suppression apparatus 1 via the clamping claw 10 of the limiting device 8, wherein the number of clamping claws 10 may be determined according to the number of connecting rods 5, i.e. the number of the connecting rods 5 may be two or more, which is determined according to application conditions.

Figure 3:
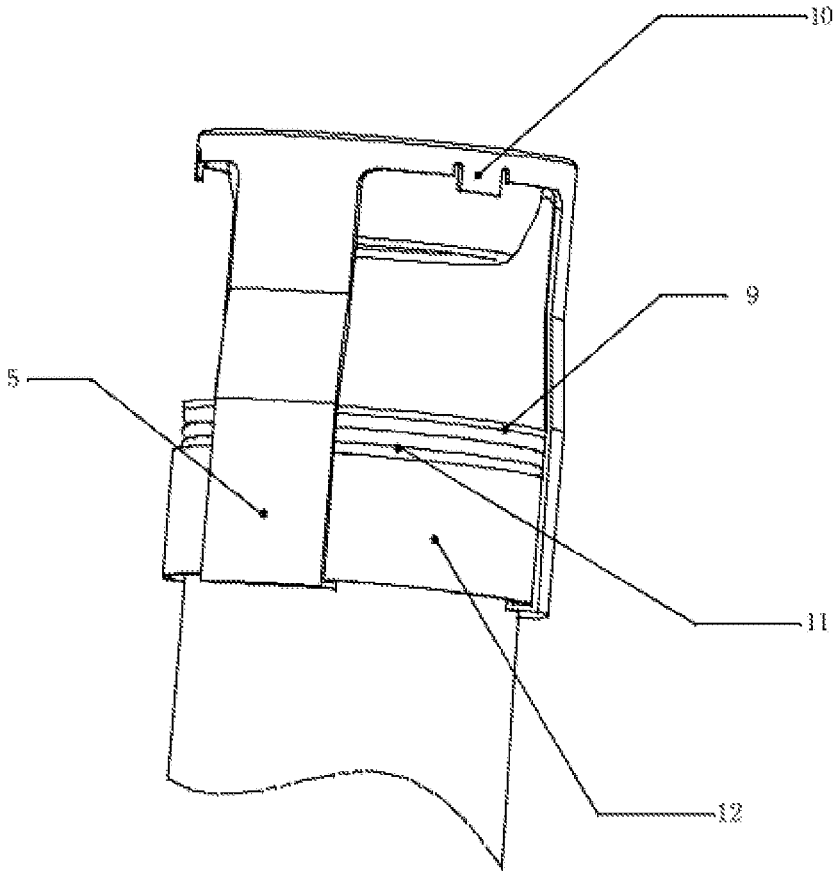
FIG. 3 is a diagram illustrating a final state of an explosion-venting device of an embodiment of the present invention.

When the aerosol fire suppression apparatus 1 sprays normally, a hot gas is released from the nozzle of the aerosol fire suppression apparatus 1 without generating an overlarge air stream, then the explosion-venting device 2 is not started, and the connecting rod 5 which is fixed on the cylinder body 3 by the clamping claw 10 will not move axially along the cylinder body 3 to displace. Only when the gas with an extremely high pressure, which is generated by a deflagration of an agent, is accumulated in the cylinder body to push a cylinder cover assembly 4 and the connecting rod 5 to move in a direction that a hot air stream is jetting towards until the extremity of the connecting rod 5 moves to the front end of the connecting rod 5 to be separated with the cylinder body 3 of the aerosol fire suppression apparatus 1, the clamping claw 10 of the limiting device 8 is detached by the powerful impact force on one hand to consume a part of the kinetic energy. At the moment, the connecting rod 5 will slide axially along the cylinder body 3 to displace, and a frictional resistance is generated by the friction layer 7 on the connecting rod during the moving process to consume a part of the kinetic energy. When the extremity of the connecting rod 5 reaches the nozzle of the cylinder body 3, as shown in FIG. 3, the flanging 9 of the limiting device 8 fixed on the cylinder body 3 stops the extremity of the connecting rod 5 from being separated from the cylinder body 3. At the moment, the buffering component 11 arranged between the flanging 9 and the guiding ring 12 functions to consume a part of the kinetic energy with the elasticity thereof. In addition, the buffering component buffers the powerful impact force between the extremity of the connecting rod 5 and the flanging 9. At the same time, when the impact force exceeds the bearing strength of the flanging 9, the flanging 9 is distorted elastically or plastically to further consume a part of the kinetic energy, thus the powerful kinetic energy formed by the power hot air stream generated by a deflagration of the grain of the aerosol fire suppression apparatus 1 can be well consumed in the whole process without generating an excessive recoil force. In addition, the hot air stream will not be accumulated too much in the cylinder body 3 to cause an explosion. At the same time, the explosion-venting device 2 will not be separated from the aerosol fire suppression apparatus 1, thus avoiding injuries to personnel and damages to materials.

The displacement of the connecting rod 5 of the present invention is within 30 mm to 80 mm, preferably 50 mm to 60 mm, which may be adjusted adaptively, however, according to the size of the cylinder body 3 of the aerosol fire suppression apparatus 1, and the dosage of an agent loaded therein etc.

The explosion-venting device of the present invention is not limited to the portable aerosol fire suppression apparatus above only, it is further applicable to a fixed fire suppression apparatus, and is also assembled at a cylinder body opening of an inner cylinder in the fixed fire suppression apparatus, or it may be further applied on other similar products or occasions involving explosion preventing (venting) requirements and recoil force reduction.

The invention claimed is:

1. An explosion-venting method for an aerosol fire suppression apparatus, wherein the method comprises the following steps:

1) when the aerosol fire suppression apparatus deflagrates, an explosion-venting device matching the aerosol fire suppression apparatus generates a limited displacement along a direction that a hot air stream of the aerosol fire suppression apparatus is jetting towards;

2) when an extremity of the explosion-venting device reaches an edge of the aerosol fire suppression apparatus, being limited, the explosion-venting device stops the displacement along the direction that the hot air stream of the aerosol fire suppression apparatus is jetting towards, thus achieving for the aerosol fire suppression apparatus the purpose of explosion-venting, wherein the explosion-venting device comprises a friction layer, a connecting rod, a guiding unit and a limiting device;

the guiding unit provides a sliding guide function for the connecting rod when the connecting rod is moving;

the connecting rod is fixedly connected with the aerosol fire suppression apparatus through the limiting device; when an extremity of the connecting rod is to be separated from the aerosol fire suppression apparatus, the limiting device limits the connecting rod.

2. The explosion-venting method for the aerosol fire suppression apparatus according to claim 1, wherein the guiding unit is a guiding ring fixedly connected with the connecting rod or a guiding groove arranged on an outer wall of the aerosol fire suppression apparatus and capable of making the connecting rod slide along the guiding groove.

3. The explosion-venting method for the aerosol fire suppression apparatus according to claim 1, wherein the limiting device is arranged on one end, which is arranged with a nozzle, of the aerosol fire suppression apparatus.

4. The explosion-venting method for the aerosol fire suppression apparatus according to claim 1, wherein a displacement of the connecting rod is within 30 mm to 80 mm.

5. The explosion-venting method for the aerosol fire suppression apparatus according to claim 4, wherein the limiting device comprises a flanging fixedly connected with a nozzle end of the aerosol fire suppression apparatus and a clamping claw for fixing the connecting rod.

6. The explosion-venting method for the aerosol fire suppression apparatus according to claim 5, wherein a buffering component is further arranged between the flanging and the guiding ring.

7. The explosion-venting method for the aerosol fire suppression apparatus according to claim 1, wherein the aerosol fire suppression apparatus is a portable fire suppression apparatus or a fixed fire suppression apparatus.

8. The explosion-venting method for the aerosol fire suppression apparatus according to claim 2, wherein a displacement of the connecting rod is within 30 mm to 80 mm.

9. The explosion-venting method for the aerosol fire suppression apparatus according to claim 3, wherein a displacement of the connecting rod is within 30 mm to 80 mm.

* * * * *